United States Patent [19]

Federer

[11] Patent Number: 4,618,289

[45] Date of Patent: Oct. 21, 1986

[54] METHOD OF FORMING A CAST-IN-PLACE SUPPORT COLUMN

[76] Inventor: David L. Federer, 5058 Sirron Ct., Dunwoody, Ga. 30338

[21] Appl. No.: 599,727

[22] Filed: May 22, 1984

[51] Int. Cl.[4] ..... E02D 5/34

[52] U.S. Cl. ..... 405/236; 405/233; 405/239; 405/241

[58] Field of Search ..... 405/240, 241, 242, 243, 405/239, 237, 232, 233, 236; 249/10

[56] References Cited

U.S. PATENT DOCUMENTS

| | | | |
|---|---|---|---|
| 3,206,935 | 9/1965 | Phares | 405/242 |
| 3,303,244 | 2/1967 | Talley et al. | 405/237 X |
| 3,540,225 | 11/1970 | Muller | 405/242 |
| 3,638,433 | 2/1972 | Sherard . | |
| 3,685,303 | 8/1972 | Turzillo | 405/237 X |
| 3,851,484 | 12/1974 | Steding . | |
| 3,851,485 | 12/1974 | Steding . | |
| 3,925,998 | 12/1975 | LeCorgne | 405/242 |
| 4,018,056 | 4/1977 | Poma . | |
| 4,152,089 | 5/1979 | Stannard | 405/242 |

*Primary Examiner*—Dennis L. Taylor

[57] ABSTRACT

Method for making an elongated support column extending downwardly into the ground which may be used in the construction of foundation piling, tension anchors and related installations, the method comprising generally the steps of providing a rigid elongated hollow driving mandrel with radial apertures in the lower section and having a driving foot on its lower end; passing the driving foot through and displacing the ground to form a space with a cross-sectional area greater than the mandrel in the wake of the driving foot until the uppermost radial apertures in the driving mandrel are below the level of the ground; continuing the driving of the driving mandrel and foot by introducing liquified fill material under pressure into the hollow portion of the mandrel, the pressure being adjusted so as to fill the space between the mandrel and the walls of the hole so as to prevent the ground from collapsing upon the mandrel; allowing the liquified fill material to solidify when the desired depth has been reached. The driving foot of the mandrel in all cases is left within the hole and in some instances the driving mandrel is releasably coupled with the driving foot and removed before the liquified fill material solidifies, depending on the type of structure being built.

8 Claims, 5 Drawing Figures

METHOD OF FORMING A CAST-IN-PLACE SUPPORT COLUMN

BACKGROUND OF THE INVENTION

The present invention relates to a method for forming a cast-in-place support column below the surface of the ground. In particular, it relates to a method for forming cast-in-place concrete piles by driving into the ground a driving foot coupled to a hollow driving mandrel to form the bore hole with the mandrel having radial apertures in the lower section and introducing concrete under pressure into the hollow portion of the mandrel so that the some of the concrete is conveyed through the apertures into the area (i.e., annulus) between the surfaces of bore hole and the mandrel to prevent the ground from collapsing around the mandrel.

Foundation piles, or support columns, are typically utilized in supporting structures such as bridges, piers, and buildings. Support columns or piles are preferably formed of concrete and utilize a minimum of steel reinforcing members. A bore is formed in the ground of the desired depth, and concrete fill material is then introduced into the bore thus formed and allowed to cure or harden.

A number of prior art methods and apparatus have been proposed for forming a cast-in-place support column. A method is disclosed in U.S. Pat. No. 3,638,433 to Sherard. Sherard discloses forcing a mandrel with a drive foot into the soil to form a space with a cross section greater than the mandrel in the wake of the drive foot and filling this space with concrete supplied at the ground surface with the concrete flowing downwardly along the mandrel behind the drive foot. In some cases the mandrel is detachable from the drive foot and removed prior to the concrete hardening. In other cases the mandrel is left as a part of the structure.

U.S. Pat. No. 3,851,484 to Steding discloses a hopper for containing the concrete. The mandrel is driven through an aperture in the bottom of the hopper with the concrete flowing through the space between the mandrel and the aperture walls. Steding shows a mandrel in FIG. 2 which is hollow and has a plurality of radial apertures 52. These radial apertures extend along the entire length of the mandrel and are designed to permit the flow of concrete in the space between the mandrel and the surface of the bore hole and into the hollow interior of the mandrel. Concrete is basically supplied by gravity from a hopper on the surface to the outside of the mandrel and in the case of a hollow mandrel to the interior of the mandrel through radial apertures.

U. S. Pat. No. 4,018,056 to Poma discloses a pile driving apparatus with a mandrel that is driven through a discharge opening of a fill hopper. Concrete flows through this opening and into the pile-forming hole as it is being formed. The mandrel has apertures so that concrete can flow into the interior of the mandrel.

U.S. Pat. No. 3,851,485 to Steding discloses a hollow mandrel with radial apertures in FIG. 29. It too is designed for the concrete to be supplied by gravity into the space between the mandrel and the surface of the bore hole with the interior of the mandrel being filled with concrete through the radial apertures.

U.S. Pat. No. 4,152,089 to Stannard discloses the method for introducing liquified fill material into the mandrel under pressure. The hollow mandrel and driving foot are driven in the normal manner. When the desired depth has been reached, fill material is introduced under pressure to the bottom hollow portion of the mandrel. In this way the pressure from the liquified fill material is used to extract the mandrel from the bore hole and to fill the bore hole with concrete. The partition plate provided in the bottom portion of the mandrel has an aperture connected to a conduit for the fill material passing through the partition plate.

U.S. Pat. No. 3,925,998 to Le Corgne discloses using a hollow mandrel with radial apertures which is driven through a hopper box. The fill material flows along the outside of the mandrel into the bore hole and enters the inside of the mandrel through the radial apertures.

One of the problems encountered in driving piles is the constriction of the pile near the bottom as it is being driven. As the driving foot is driven into the ground, forces emanating from the foot cause the ground directly beneath the foot to rotate out from under the foot and to continue to rotate until they act inwardly on the pile hole surface some distance above the location of the foot. When concrete is gravity fed into the area between the mandrel and the surface of the pile hole, the concrete has a tendency to prevent this from occurring. The extent to which it prevents this from occurring is dependent upon the head pressure of the concrete and the forces emanating from the foot. Unfortunately, in many cases the head pressure of the concrete is not sufficient to prevent the constriction of the pile. Constriction is likely to be greater in some of types of soil than others. It becomes a particularly acute problem in some types of clay.

Another problem encountered with a pile where the concrete is gravity fed along the outside of the pile is that a large amount of concrete can be wasted when driving through porous material such as sand. Gravity filling of concrete must occur through the entire driving operation in order to ensure that an adequate amount of concrete is contained in the bottom of the pile. Thus, in driving through a section of porous sand the concrete must continue to be poured into the hole, and it will spread out through the sand formation and not increase the strength of the pile.

The object of the present invention is to develop a method for formation of cast-in-place columns so that the constriction of the pile is minimized. Another object of the invention is the development of a method of preventing the loss of a large amount of concrete while driving a pile through porous structure such as land fill or cavernous limestone.

Other objects, advantages and capabilities of the present invention will become apparent from the following detailed desciption, taken in conjunction with accompanying drawings illustrating the preferred embodiments of the invention.

SUMMARY OF THE INVENTION

The above disadvantages have been overcome by the present invention which is basically a method of forming a cast-in-place column. The apparatus includes a hollow driving mandrel with radial apertures in the lower section of the mandrel and a conduit for supplying concrete or grout under pressure to the hollow portion of the mandrel. The driving foot is attached to the bottom of the mandrel. The diameter of the driving foot is slightly greater than the diameter of the mandrel. The mandrel with the driving foot is driven into the ground in a conventional way such as by repeated hitting with a pile driver on the top of the mandrel. After the mandrel is driven into the ground so that the uppermost apertures are below ground level, concrete or grout is supplied under pressure to the interior of the mandrel. Concrete flows to the bottom of the mandrel and out through the apertures to fill the space between the mandrel and the surface of the hole. The flow of the concrete is regulated so that it is sufficient to prevent soil underneath the driving foot from rotating upwardly and constricting the mandrel. If the flow constricts the mandrel, it decreases the strength of the support column and also increases the friction on the mandrel during driving. The pressure is adjusted so as to avoid the concrete flowing out the top of the pile and onto the surface of the ground. If necessary, a sleeve or a packer can be placed around the mandrel at ground level to prevent this from occurring. After the mandrel has been driven to the desired depth, the mandrel can be left in place with the driving foot to solidify into a column. Alternatively, the mandrel can be releaseably coupled to the driving foot and withdrawn from the column before the concrete sets.

In the process of driving the column in a section of very porous soil such as sand, the operator may detect a great increase in the flow of concrete and a consequent drop in the pressure which indicates that the concrete is flowing out into the porous structure. Consequently, the concrete being pumped can be decreased until the column has penetrated this section at which time the pressure can then again be increased. By carefully observing changes in pressure and flow of the concrete, the operator can make sure that all of the concrete being pumped will be part of the column and that the column will not be constricted.

In order to increase the pressure of the concrete against the walls of the hole, a packer or sleeve may be installed at ground level. This prevents the pressure being elevated to such a degree that the concrete flows up through the hole and onto the surface of the ground. After having driven through a porous section where the amount of concrete being pumped is reduced, an inflatable packer can be installed at the bottom of such formation and increased pressure exerted against the walls of the hole to prevent losing concrete upward in the hole and into the porous formation.

DESCRIPTION OF THE ILLUSTRATIVE EMBODIMENTS

Figure 1:
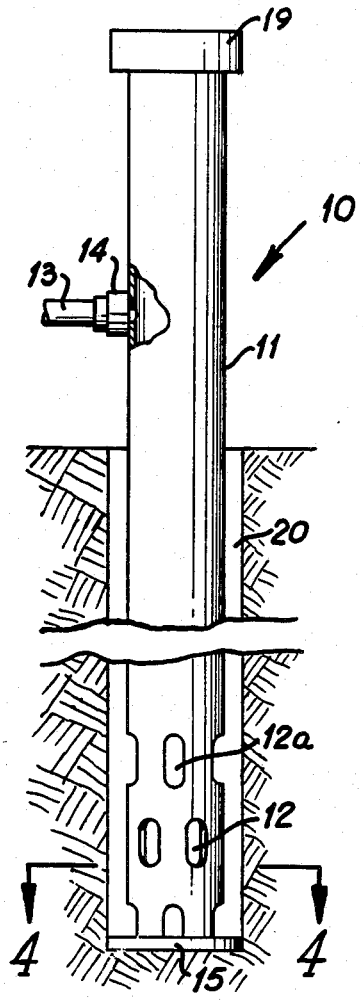
FIG. 1 is a view in elevation and section of the apparatus utilized in forming the column embodying the principles of the present invention.

Referring now to the drawings, the apparatus required to perform a pile forming operation utilizing the principles of the present invention will be described, followed by the methods of the pile forming operation.

Figure 4:
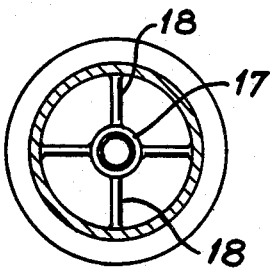
FIG. 4 is a cross-sectional view taken along line 4—4 of FIG. 1.
Figure 5:
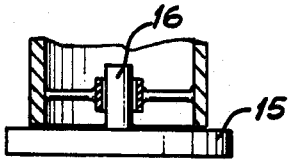
FIG. 5 is a side elevational view in cross section of one embodiment driving foot.

In FIG. 1, the apparatus used in the pile forming method is shown and generally represented by the reference number 10. The pile forming apparatus 10 includes hollow rigid driving mandrel 11, with a cylindrical shape and having radial aperatures 12 in the lower section of the mandrel. The driving mandrel 11 would typically have a diameter between 9 inches to 3 feet and a length of between 20 and 80 feet in accordance with the length of the support column that is desired. The wall thickness of the driving mandrel 11 may vary from approximately 0.3 inches to 1 inch. The conduit 13 from a grout pump (not shown) is interconnected to the interior of the mandrel 11 through a fitting 14. The driving foot 15 is releaseably coupled to the mandrel 11. A stem 16 projects upwardly in the center of the driving foot 15 into a collar 17 which is affixed to the mandrel 11 by braces (as shown in FIGS. 4 and 5). The driving foot 15 has a slightly greater diameter than the mandrel 11. It serves to reduce the friction that would otherwise be encountered between the surface of the mandrel and the walls of the hole as it is being driven. The mandrel is held in proper position by the stem 16 which projects through the collar 17 attached to the mandrel. The driving foot can also be held in proper place by a variety of different ways. The most common is for the driving foot 15 to be affixed to a circular sleeve that encircles the lower section of the mandrel. This type of driving foot and sleeve can be used with this invention. It is not preferred because of the desirability of having apertures in the lower section of the mandrel. Driving head 19 is attached to the top of the mandrel.

Figure 2:
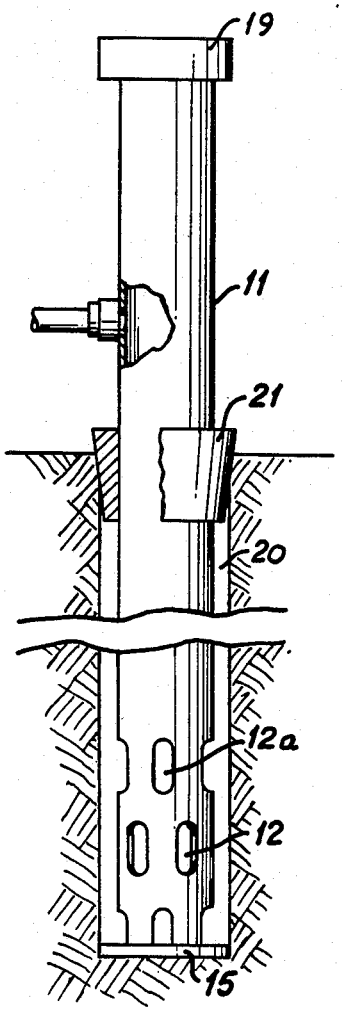
FIG. 2 is a view in elevation and section of the present invention showing a sleeve around the mandrel at ground level.
Figure 3:
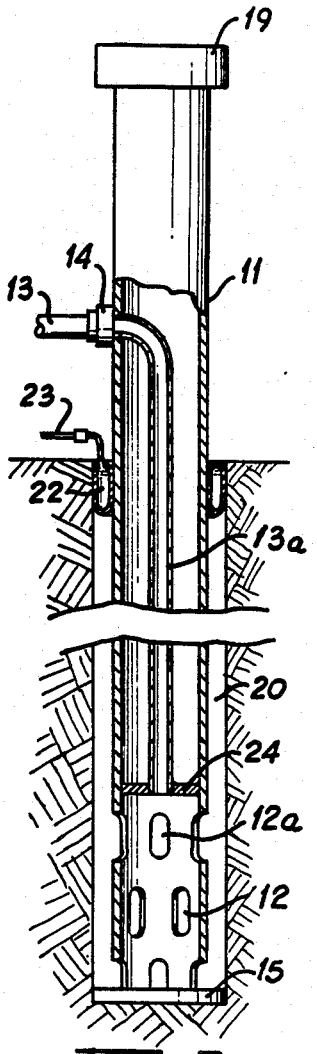
FIG. 3 is a view in elevation and section of the present invention showing an inflatable packer of the mandrel at ground level.

The method of forming support columns utilizing apparatus 10 can now be described with particular reference to FIG. 1. Driving foot 15 is first positioned on the ground surface at the desired location of a support column. Driving mandrel 11 is then placed on the driving foot so the stem 16 of the driving foot is located within the collar 17. Conduit 13 is interconnected with the grout pump and the mandrel 11. Pile driver (not shown) commences driving the driving foot and mandrel into the ground by repeatedly striking driving head 19. Concrete is not pumped into the mandrel until the uppermost aperature **12*a* of a mandrel is below ground level. The grout pump can then be turned on to pump concrete or grout through conduit 13 into the interior of the mandrel 11. Some of the grout will exit through apertures 12 into the space between the surface of the mandrel and the walls of the hole (i.e. annulus 20). The grout pump can be provided with a pressure gauge and a metering gauge, to monitor the grout flow from the pump. If an excessive amount of grout is pumped into the mandrel 11 during the driving, it may exit through annulus 20 and flow onto the ground. A sufficient amount of pressure is exerted on the grout to prevent ground being displaced by driving foot 15 from rotating around the foot and into annulus 20. The grout pump can be used to prevent the normal tendency of ground beneath the driving foot to rotate around the driving foot and constrict mandrel resulting in a weakened column. A sleeve 21 shown in FIG. 2 can be placed around the mandrel at the surface of the ground to impede the upward flow of grout. This sleeve may have a smaller diameter at the bottom to ensure that the annulus 20 is completely blocked. In this way greater grout pressure can be maintained. Greater grout pressure can be maintained by the use of an inflatable packer 22 as shown in FIG. 3. The packer is connected by a conduit 23** to an air pump. In this way a tight seal is effected between the surface of the mandrel and the ground. Greater grout pressure can be exerted under these circumstances. In driving the mandrel into formations that are extremely porous, such as sand, the tendency for the grout to flow into the porous formation, of course, does not increase the strength of the column; it results in waste of the grout. This type of event will be apparent from a careful monitoring of the pressure and metering gauges so that the amount of grout being pumped can be decreased as this occurs. Pressure can be increased as the bottom of the mandrel enters into a less porous formation. A packer could be installed at the bottom of the porous formation in order to increase the pressure in driving the mandrel further into the ground.

After the mandrel is driven to the desired depth, it can be left in place to solidify and to form a part of the support column. If desired the mandrel can be withdrawn from the concrete before it sets so that the column is entirely concrete. The foot 15 will remain in the hole, and the mandrel can easily be withdrawn. The stem 16 is not affixed to the collar 17. As the mandrel is being removed, additional grout can be pumped in to replace area vacated by the mandrel.

The second embodiment of the invention shown in FIG. 3 especially applicable to forming support column where it is desired to remove the mandrel or it is necessary to be able to maintain a low head pressure in the mandrel as when driving through very porous formations. Conduit 13 is connected to the mandrel through fitting 14 connected to interior conduit 13*a*, extends through a partition plate 24 in the interior of the mandrel's lower section.

The apparatus shown in FIG. 3 is driven in the same manner as the apparatus shown in FIG. 1 with certain exceptions. After the mandrel is driven until the uppermost apertures 12*a* are below the surface of the ground, pumping of grout can commence. The packer 22 installed at the surface of the ground is an optional feature. Partition 24 enables the head pressure of the concrete to be reduced which prevents excessive loss of concrete when driving through porous formations. When the desired depth has been reached, the mandrel 11 can either be left in place or withdrawn. If the mandrel is withdrawn, it is necessary to continue pumping grout as it is withdrawn in order to fill the space in the column that was formerly occupied by the upper section of the mandrell which does not contain any grout. The amount of grout that is required to be pumpted can be determined by observing the grout level in the annulus. However, if it is desired to enhance the strength the mandrel and to leave it in place, the upper portion of the mandrel can be filled with grout if the driving head 19 is removed.

In driving in marine applications, protection against the introduction of water into the mandrel can be obtained by the use of one-way valves in lieu of aperture 12. This will prevent the introduction of water into the mandrel during the initial phases of driving. Another approach is to use shaped charges to form the apertures 12 after the mandrel has been driven into the sea floor. The charges are then exploded and the driving re-commenced with grout being pumped. One-way valves or shaped charges also are useful when driving through soft soil, such as land fill, where it may not be desirable to pump grount as most of it would flow into the soil and not add to the strength of the column. After the mandrel is driven through the section, the charge is exploded and concrete pumping commenced.

What is claimed:

1. A method of forming a cast-in-place support column of solid diameter comprising the steps of:

a. Positioning a driving foot, having a portion of cross-sectional shape and size corresponding to the desired cross-sectional shape and size of the support column, into contact with the ground surface at the desired column location;

b. Positioning an elongated hollow rigid driving mandrel, having a cross-sectional size slightly smaller than the driving foot, with the mandrel having an upper and a lower section;

c. Driving the driving foot and the mandrel into the ground to a desired depth;

d. Continuing to drive the driving foot and mandrel while introducing liquified fill material under pressure into the hollow portion of the driving mandrel so as to substantially fill the lower section of the hollow mandrel with fill material as desired, the pressure on the liquified fill material being maintained so that a portion of the liquified fill material is conveyed through a plurality of radial apertures in the lower section of the mandrel to exert a pressure against walls of the hole surrounding the mandrel so as to prevent the walls from collapsing upon the mandrel and adjusting the pressure so as to avoid the excessive loss of liquified fill material out of the area in which the support column is to be formed;

e. Allowing said liquified fill material to harden to form the support column when the desired depth is obtained.

2. The method of claim 1 further comprising the step of withdrawing the driving mandrel from the support column before the liquified fill material has set sufficiently so that mandrel withdrawal would damage the support column, the mandrel being releaseably coupled to the driving foot.

3. The method of claim 1 wherein packer means are placed around a cross section of the mandrel to prevent escape of liquified material past such packer means during the time that liquified fill material is being introduced into the lower section of the mandrel under pressure.

4. The method of claim 1 wherein the plurality of radial apertures in the lower section of the mandrel are formed by exploding shaped explosive charges prior to commencing the introduction of liquified fill material to the hollow portion of the driving mandrel.

5. The method of claim 1 in which the plurality of radial apertures in the lower section of the mandrel are one-way valves which allow the liquified fill material to exit from the interior of the mandrel.

6. The method of claim 1 wherein a partition plate divides the upper and lower sections of the mandrel so that the liquified fill material is only introduced under pressure into the hollow portion of the lower section of the driving mandrel.

7. The method of claim 6 comprising the step of withdrawing the driving mandrel from the support column before the liquified fill material has set sufficiently so that mandrel withdrawal will not damage the support column, the mandrel being releaseably coupled to the driving foot, with liquified fill material being pumped under pressure into the hollow portion of the lower section of the driving mandrel during withdrawal of the mandrel in order to form a support column of the desired cross sectional size and shape throughout the entire length of the support column.

8. The method of claim 1 wherein the upper end of the mandrel is sealed and the fill material is introduced under pressure into substantially the entire hollow portion of the driving mandrel.

* * * * *